US006187147B1

(12) United States Patent
Doerksen

(10) Patent No.: US 6,187,147 B1
(45) Date of Patent: Feb. 13, 2001

(54) DELAYED COKER UNIT FURNACE

(75) Inventor: Brian J. Doerksen, Sulphur, LA (US)

(73) Assignee: Conoco Inc., Ponca City, OK (US)

( * ) Notice: Under 35 U.S.C. 154(b), the term of this patent shall be extended for 0 days.

(21) Appl. No.: 09/079,889

(22) Filed: May 15, 1998

(51) Int. Cl.[7] ..... C10B 21/20; C10B 49/00; C10B 55/00; C22C 38/18

(52) U.S. Cl. ..... 202/99; 208/50; 420/34; 427/252

(58) Field of Search ..... 202/99, 209, 85–87, 202/165; 427/250, 252; 208/48 R, 50; 420/34–71; 201/10

(56) References Cited

U.S. PATENT DOCUMENTS 3,811,872 * 5/1974 Snape ..... 420/585
4,389,439 6/1983 Clark et al. ..... 138/146
4,826,401 5/1989 Clark et al. ..... 415/200
4,919,793 * 4/1990 Mallari ..... 208/131
5,064,691 * 11/1991 Kirner et al. ..... 427/252
5,324,544 * 6/1994 Spence et al. ..... 427/397.7

* cited by examiner

*Primary Examiner*—Shrive Beck
*Assistant Examiner*—Alexa A. Doroshenk
(74) *Attorney, Agent, or Firm*—Cortlan R. Schupbach Hsiang-ning Sun

(57) ABSTRACT

The return bend elbow fittings connecting adjacent tubes in a delayed coker furnace are improved by subjecting the interior surface of the fittings to a diffusion hardfacing process.

2 Claims, 3 Drawing Sheets

DELAYED COKER UNIT FURNACE

BACKGROUND OF THE INVENTION

This invention relates to delayed coking, and more particularly to an improvement in coker furnaces associated with delayed coking units.

In the delayed coking process, a petroleum residuum is heated to coking temperature in a coker furnace, and the heated residuum is then passed to a coking drum where it decomposes into volatile components and delayed coke. The delayed coking process has been used for several decades, primarily as a means of producing useful products from the low value residuum of a petroleum refining operation.

Coker furnaces typically include multiple banks of heater tubes wherein each bank is comprised of a series of straight sections connected by return bend elbow fittings. During the operation of the coker unit, in which the coker feedstock is heated to temperatures of 900° F. or more, the furnace tubes become fouled by coke deposition on the interior surface of the tubes. As this fouling process progresses, the furnace efficiency drops, and progressively more severe furnace conditions are required to heat the incoming feed to coking temperature. As a result of this internal furnace tube fouling, it is necessary to periodically decoke the furnace tubes.

There are several methods used to decoke the furnace tubes. In some procedures, the furnace is taken out of service during the decoking procedure. In other procedures, only a part of the tube banks are removed from service. In all cases, production is either halted or reduced during the furnace decoking process.

One decoking procedure, sometimes referred to as on-line spalling, involves injecting high velocity steam and cycling the furnace tube temperature enough, such as between 1000° F. and 1300° F., to cause contraction and expansion of the tube, with resultant flaking off of the accumulated coke deposits, which deposits are then blown from the furnace tubes by steam flow. This procedure can be carried out on a portion of the tube banks while another portion of the tube banks remains in production.

Another decoking procedure involves injection of air along with the steam at some stage of the decoking. Because the tubes are still very hot during the decoking, the air combusts the coke deposits, such that there is a combined spalling and combustion of coke.

The above-described decoking procedures, including variations thereof, are well understood by those in the coking industry.

A common problem in decoking is that coke particles removed by the decoking process cause erosion of the furnace tubing, particularly at the return bend elbow fittings connecting adjacent straight sections of furnace tubing.

In the past, the erosion problem has been addressed in a number of ways, including using an erosion resistant metal composition, using very thick-walled piping, and in some cases by adding a weld overlay to the most erosion-prone sections of the piping.

In U.S. Pat. Nos. 4,389,439 and 4,826,401 to Clark, a technique for improving the erosion resistance of metal surfaces is described. The technique includes a boron diffusion step to improve the erosion resistance of metal piping.

SUMMARY OF THE INVENTION

According to this invention, the erosion resistance of furnace tube fittings is enhanced by subjecting the interior surface of the fittings to a diffusion hardfacing process. The resulting hardfaced surfaces provide increased life of the fittings compared to untreated fittings, providing increased safety and improved operating efficiencies.

DESCRIPTION OF THE PREFERRED EMBODIMENTS

Figure 1:
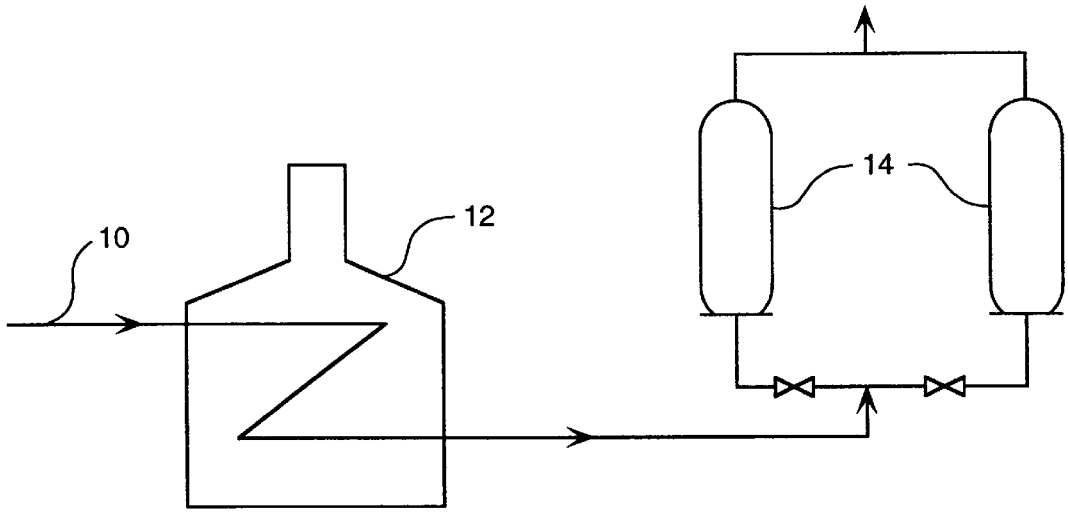
FIG. 1 is a schematic view of a portion of a delayed coker unit.

The present invention is directed to delayed coker units of the type shown generally in FIG. 1. As shown therein, feedstock from feedline 10 passes through furnace 12 where it is heated to coking temperature and then fed to one of a pair of coke drums 14.

Figure 2:
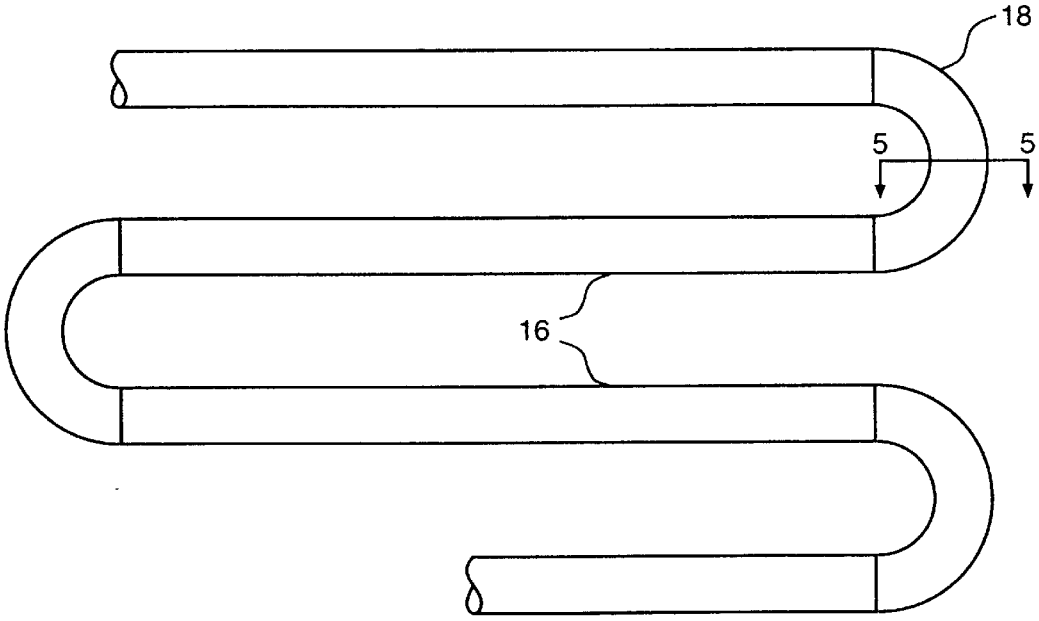
FIG. 2 is a view showing a section of a coker furnace tube bank.
Figure 3:
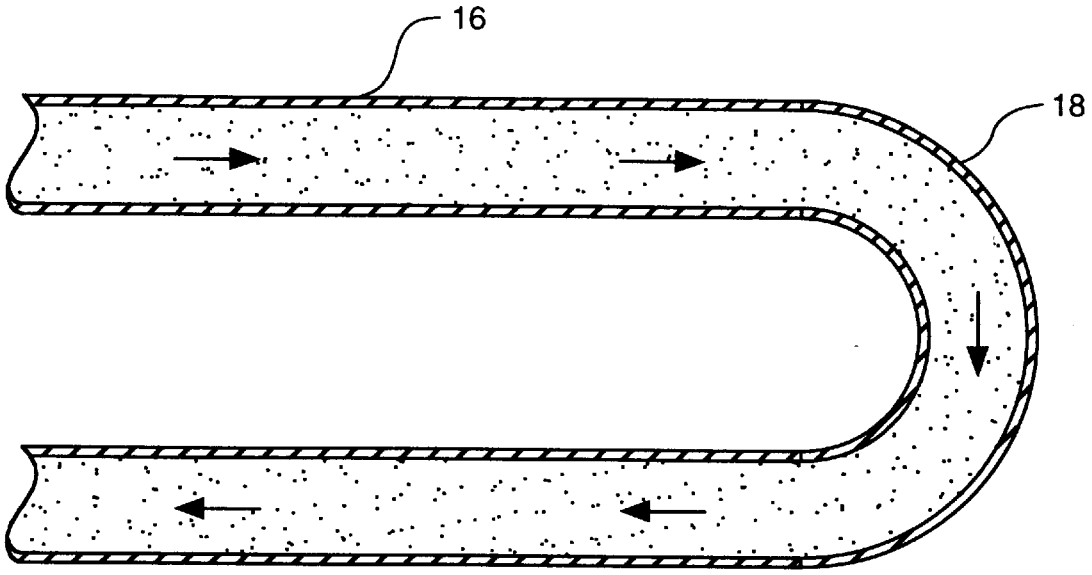
FIG. 3 is a cutaway view of a section of a coker furnace tube bank showing flow of material during decoking of the tube bank.

FIGS. 2 and 3 show portions of a furnace tube bank, of which there are often two or four in a coker furnace, with each tube bank comprised of a plurality of straight sections 16 with the ends of adjacent straight sections connected by return bend fittings 18, shown as 180° elbow fittings, but sometimes comprised of a pair of 90° elbow fittings with short straight connecting sections (not shown).

The furnace tube banks are subjected to high temperature, as the feedstock must be heated to from 850° to 900° F. or even higher.

The furnace tube bank is typically made from a high temperature service material such as a 9 percent chromium steel.

As the coking run progresses, the interior surface of the tube bank becomes gradually fouled by deposition of coke on the interior surface of the tube banks. This fouling reduces the furnace efficiency to the point that periodically, such as every few weeks or months, or in some cases after one or more years, the furnace tubes must be "decoked" to restore furnace efficiency. The decoking process results in spalling or flaking off of coke particles, which are then carried from the furnace by the steam flow.

Figure 4:
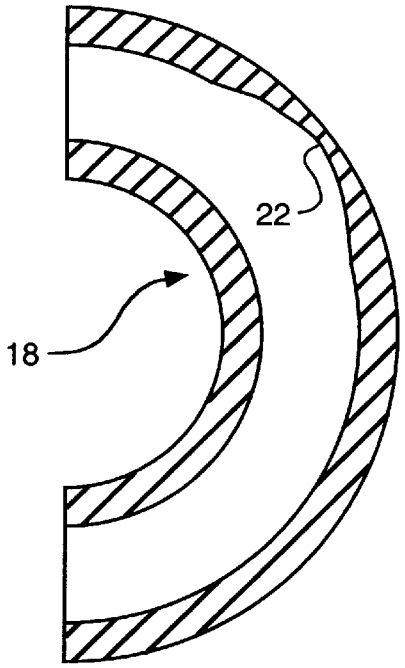
FIG. 4 is a cut-away view of a return bend fitting showing the effects of erosion on the fitting.

In any decoking process in which coke deposits are removed from the tube surface, an erosion problem is created by the high velocity flow of coke particles, particularly in the return bend fittings of the tube bank. This flow is illustrated in FIG. 3 where coke particles impact on the inner surfaces of return bend 18. In FIG. 4, an eroded area 22 is shown in fitting 18 creating a reduced thickness area, which can compromise safety. Eroded fittings such as shown in FIG. 4 are cut away from the straight tube sections and replaced by welding a replacement fitting onto the straight sections.

A typical furnace tube bank might have from twenty to twenty-five straight sections in the radiant section of the furnace, with adjacent straight sections being connected by return bend fittings. The erosion problem becomes increasingly severe as the flow progresses toward the outlet of the tube bank, due to the increasing accumulation of coke particles and increased flow velocity due to increasing temperature and decreasing pressure toward the outlet. While it is beneficial to reduce erosion in all the tube bank return fittings, a major benefit can be obtained by having an erosion resistant fitting at the last five or six return bends in the tube bank.

The above-discussed erosion problem is addressed in the present invention by hardfacing the inner surface of the fittings 18 to increase the erosion resistance of the fittings. A preferred hardfacing treatment involves subjecting the inner surface of the fittings to a boron diffusion hardfacing procedure, although alternative diffusion surface treatment may be used.

Figure 5:
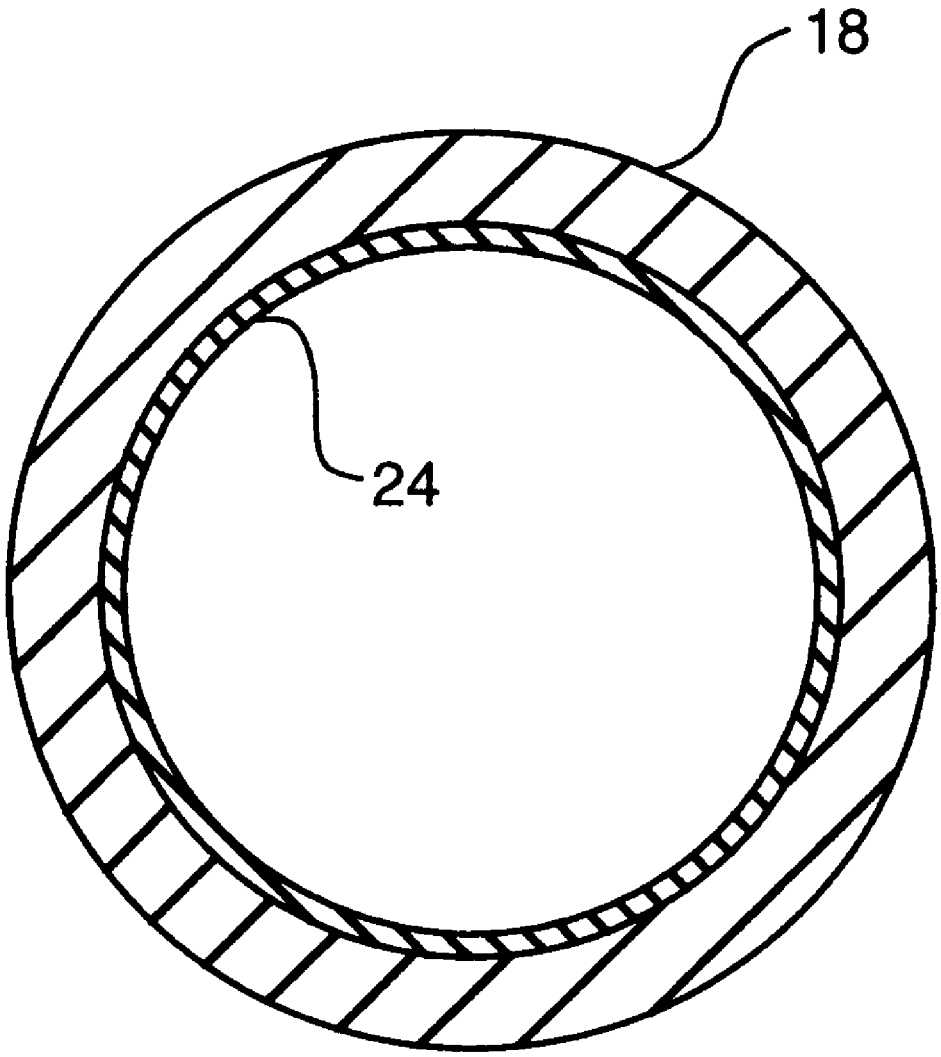
FIG. 5 is a cross section of a return bend fitting taken along the line 5—5 of FIG. 2.

The diffusion hardfacing treatment results in a hardened surface layer 24 as shown in FIG. 5, although the actual layer is typically a few thousandths of an inch in thickness, much less than that shown in FIG. 5. The hardfaced layer 24 may be produced by masking off the outer surface, packing the interior with a powdered boron compound, and heating the boron compound in a reducing atmosphere to cause boron to diffuse into the surface of the fitting. Hardfacing by diffusion is a known procedure and is readily available in the industry.

The use of return bend fittings having a diffusion hardfaced inner surface, on new tube banks or on replacement fittings, can extend the life of the fittings and increase the safety of the operation.

The essence of the present invention is in providing an erosion resistant surface on the inside of the return bend fittings in a coker furnace tube bank, resulting in reduced erosion and safer operation.

I claim:

1. A delayed coking furnace comprising:

an inlet to and an outlet from said furnace;

at least one bank of heating tubes connecting said inlet and said outlet in which said bank of heating tubes have adjacent straight tubes;

elbow bend fittings composed of approximately 9 percent chromium steel with an interior surface, said bend fittings removably connect said adjacent tubes; and a boron diffusion hardfaced layer from a boron compound applied only on said inner surface of said bend fittings which are nearest said outlet to resist erosion of said bend fittings from impact of said coke particles during decoking.

2. A process for resisting erosion of bending fittings composed of approximately 9 percent chromium steel which connect adjacent straight heating tubes in a coker furnace during decoking, which process comprises:

subjecting only an interior surface of said bend fittings to a boron diffusion hardfacing process;

decoking said furnace resulting in spalling or flaking off of coke particles; and carrying away said coke particles by high velocity of flow through said bend fitting, wherein said hardfacing resists erosion from impact of said coke particles during decoking.

* * * * *